US007384324B2

(12) United States Patent
Fullmer

(10) Patent No.: US 7,384,324 B2
(45) Date of Patent: Jun. 10, 2008

(54) PLUSH TOY WITH STRETCH INTERFACE

(75) Inventor: Russ Fullmer, 2530 Corporate Pl., Suite #A103, Monterey Park, CA (US) 91754

(73) Assignee: Russ Fullmer, San Po Kong, Kowloon (HK)

( * ) Notice: Subject to any disclaimer, the term of this patent is extended or adjusted under 35 U.S.C. 154(b) by 316 days.

(21) Appl. No.: 11/265,216

(22) Filed: Nov. 2, 2005

(65) Prior Publication Data

US 2007/0099539 A1 May 3, 2007

(51) Int. Cl.
*A63H 3/52* (2006.01)
*A63H 3/00* (2006.01)

(52) U.S. Cl. ..... 446/267; 446/369

(58) Field of Classification Search ..... 446/221, 446/226, 267, 369, 385, 183
See application file for complete search history.

(56) References Cited

U.S. PATENT DOCUMENTS 2,668,394 A * 2/1954 Auzin ..... 446/183
3,977,121 A * 8/1976 Goldfarb et al. ..... 446/369
4,648,851 A * 3/1987 Rosenberg ..... 446/372
4,952,190 A * 8/1990 Tarnoff et al. ..... 446/267
5,090,938 A * 2/1992 Reynolds ..... 446/369
5,577,723 A * 11/1996 DiResta et al. ..... 473/571
5,813,896 A * 9/1998 Spector ..... 446/221
6,126,510 A * 10/2000 Weiss, Jr. ..... 446/486
6,672,932 B1 * 1/2004 Panec et al. ..... 446/185

* cited by examiner

*Primary Examiner*—Kien T Nguyen
(74) *Attorney, Agent, or Firm*—Clement Cheng

(57) ABSTRACT

A plush toy is provided having its surface generally covered with multiple panels of fur fabric or plush fabric, which is non-stretching but soft to the touch. The toy includes a center body, a head, two ears and four legs. Eye and nose members may also be added as appropriate to model the actual animals and the like. In the belly side of the toy, a shaped patch of elastic fabric is stitched to cover a blank, which is defined by the edges of the panels of the fur fabric. The elastic fabric is free of fur and lies flush with the surrounding belly panel areas in its natural state. The head and four legs have respective cavities filled with cotton batting and the like to give a thickness and softness before or after their attachments to the center body. A bladder of elastic material such as rubber or silicon is prepared with liquid, which is filled at least partially to provide an expansive response to squeezes. The bladder is introduced into a cavity of the body through the blank and rests securely therein. The blank is then covered by an elastic fabric that acts as an interface for the toy owner to feel the elasticity of the bladder.

15 Claims, 4 Drawing Sheets

PLUSH TOY WITH STRETCH INTERFACE

BACKGROUND OF THE INVENTION

A. Field of the Invention

The present invention relates to a toy, and more particularly to a plush doll having a liquid-filled bladder that is stretchable through a wall of the doll.

B. Description of the Prior Art

Animal shaped plush dolls are typically comprised of outer furry fabrics and an inner soft filler, such as cotton, that gives the dolls volume. It has been suggested that portions of the plush dolls' filler be replaced with liquid or air.

For example, U.S. Pat. No. 5,813,896 describes a balloon that inflates a toy figure, which renders the plush toy easier to ship and launder. The future toy owner is responsible for the plush toy's complete assembly from the provided balloons and an outer plush toy figure. Inflation of the balloons underneath the outer fabric casing gives volume to the head and body parts of the figure.

This construction method bestows a convenient manner in which a toy can be easily compressed and decompressed. However, children often develop a strong emotional attachment to plush dolls because of their resemblance to actual living species. This relationship makes plush dolls unlike most other commodities in which production efficiency is priority, because the convenience of a deformable plush toy is overshadowed by children's' dissatisfaction with the unrealistic element of decompression. This emotional factor creates a continued need to improve the utility of plush toys without compromising the creatures' lifelike representation.

Accordingly, the general object of the present invention is to provide a plush toy with a squeezable liquid element that is highly sensible through a stretching interface built into the toy.

Another object is to provide a plush toy that is furry outside and watery inside at the same time to simulate the real living model in nature.

Yet another object is to provide a noninvasive plush toy with a built-in liquid bladder that entails no by-products associated with user preparation of inflatable parts.

According to the present invention, the plush toy comprises a non-stretchy outer fabric having a blank area stitched with a flexible cover. This design allows for the consumer to feel the squeezable filler inside of the doll. The filler may be a squeezable liquid element provided by an elastic water-filled bladder.

SUMMARY OF THE INVENTION

A liquid sack or bladder enclosed within a plush doll acts as a squeezable element and realistically simulates the softness and weight of a living animal. The plush toy of the present invention is shaped to resemble the body of a baby pig, yet other figures are also available. The surface of the pig toy is covered with multiple fur fabric panels that are unable to stretch but soft to the touch. This design provides for rounded overall surfaces. Various colors of fabric and patterns may be applied to distinguish the features and body parts of a specific toy; however, a single pink color may be used for the plush pig toy.

The pig toy includes a center body, a head, two ears and four legs. An elastic fabric is stitched to cover a blank in the belly side of the toy pig, which is defined by the edges of the panels of the fur fabric.

A back panel for the toy may consist of one or more pieces of fur fabric. The elastic fabric has no fur and lies flush with the surrounding belly panel areas in the toy's natural state. It is printable with characters, logos or messages of any kind.

The head and four legs have respective cavities filled with cotton batting and the like to give a thickness and softness before or after their attachments to the center body.

A nose of finer fur is attached to the head. The end surfaces of the head filler, belly, and back panels form a cavity within the center body that leaves a blank for access from the outside.

A bladder made of an elastic material, such as rubber or silicon, is prepared and at least partially filled with liquid to provide a cushiony response to squeezes. The bladder is placed into the cavity through the blank and rests securely therein. The blank is then covered by the elastic fabric, which may be stitched to the surrounding belly panel at the blank areas. The bladder is built with enough thickness and elasticity to withstand an owner's repeated squeezing.

Because the bladder is only partially filled, the finished toy makes a distinct sound when jiggled. This particular noise allows potential owners to distinguish the toy from others that may be on the market.

DETAILED DESCRIPTION OF THE PREFERRED EMBODIMENT

Figure 1:
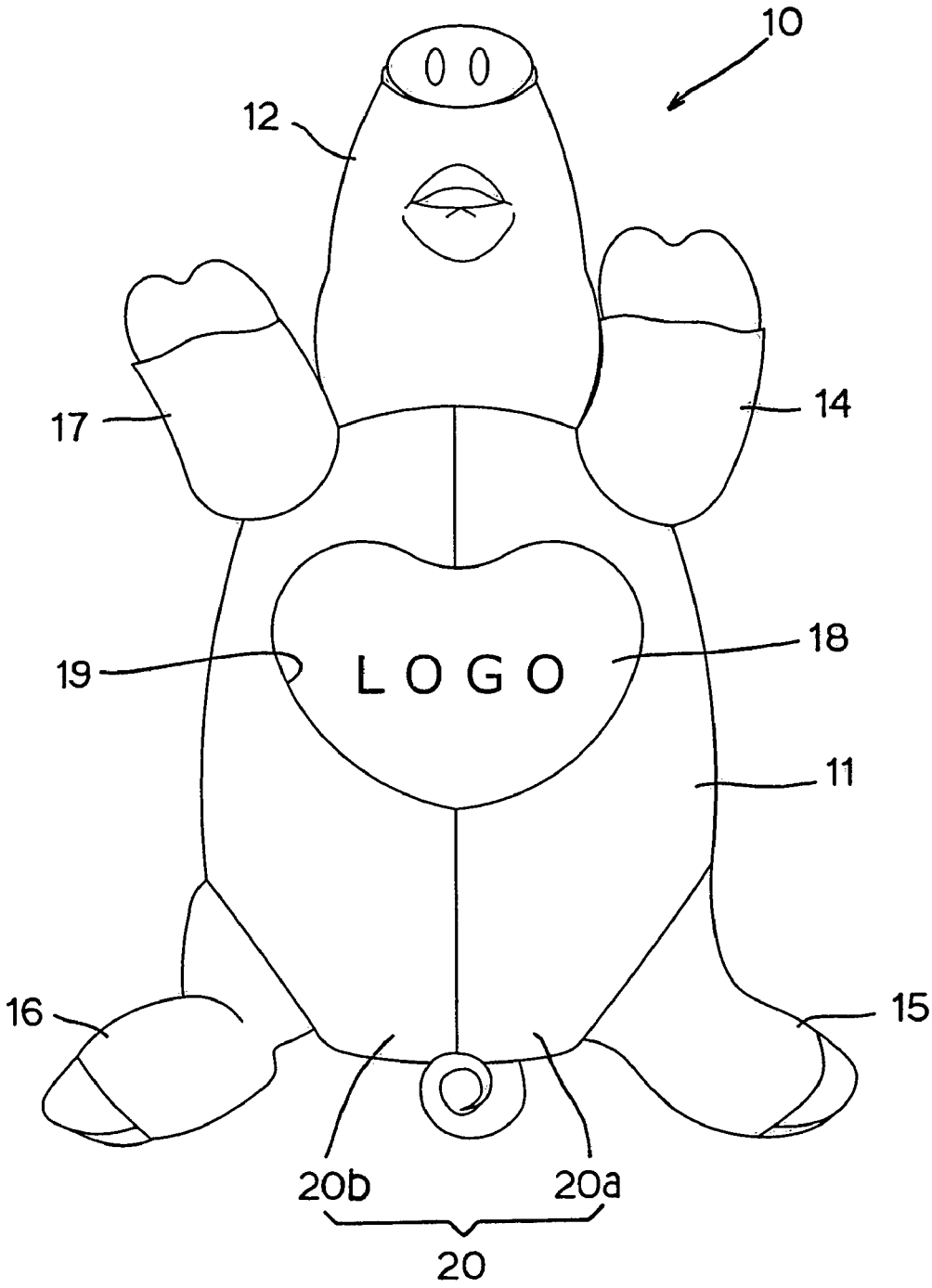
FIG. 1 is a bottom view of the squeezable toy according to an embodiment of the invention.
Figure 2:
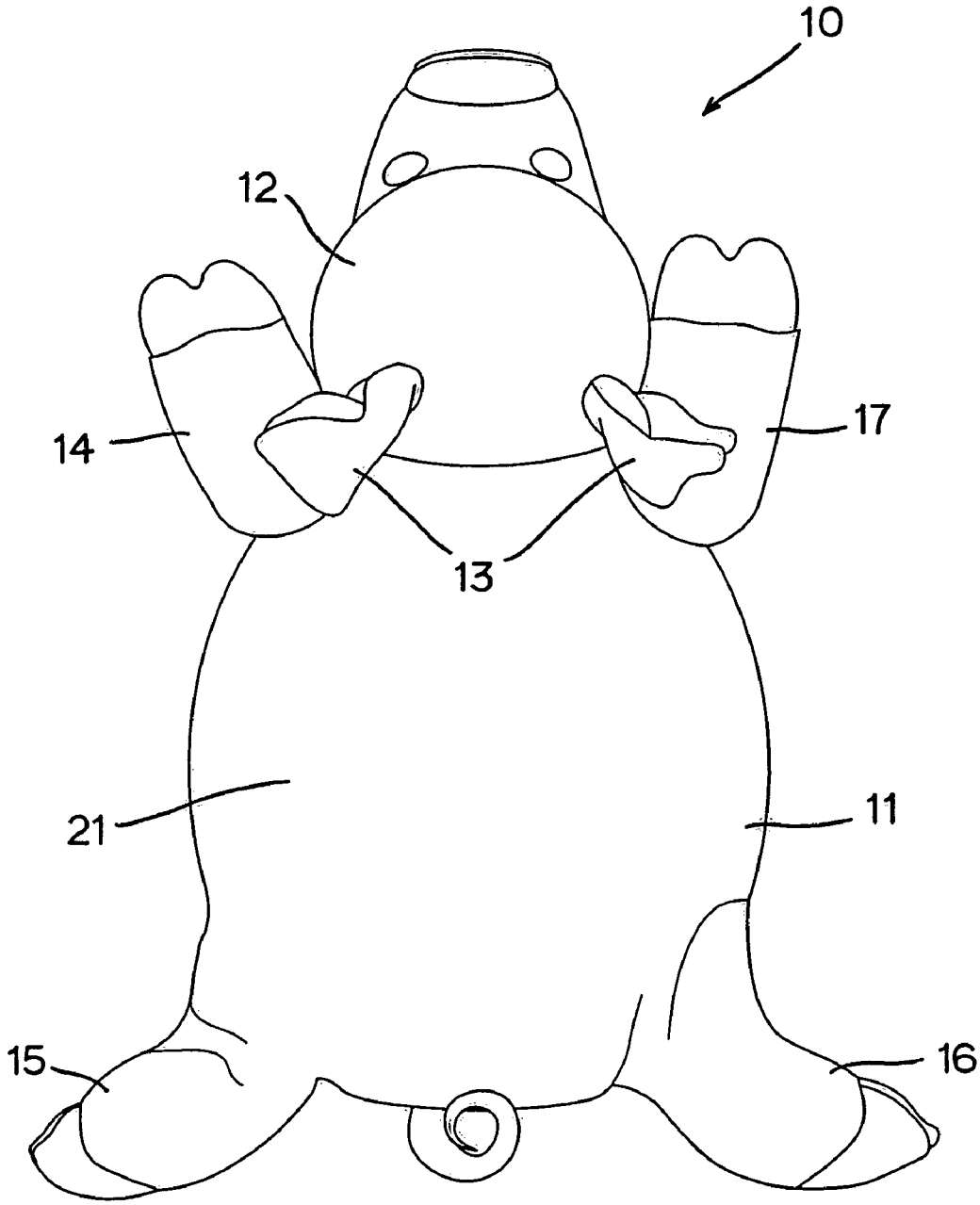
FIG. 2 is a top view of the squeezable toy of FIG. 1.

Referring to FIGS. 1 and 2, a plush toy 10 according to an embodiment of the present invention is shaped to resemble the body of a baby pig. The pig toy 10 has its surface generally covered with multiple panels of plush or fur fabric, which is non-stretching but soft to the touch. It is important to clarify that any type of plush material stretches in the literal sense, but not to a substantial degree. The consistency of the present fur fabric is considered substantially inelastic compared to a stretchable elastic portion. The soft feel of plush material is typically created by batting or stuffing that deforms when squeezed.

Various colors of fabric and patterns may be applied to distinguish the features and body parts of a specific toy; however, a single pink color may be used for the plush pig toy.

The pig toy 10 includes a center body 11, a head 12, two ears 13 and four legs 14-17 in clockwise direction of FIG. 1. If needed, eye and nose members may also be added to accurately imitate the physical characteristics of the various animals. In the belly side of the toy pig 10 in the same drawing, a heart shaped elastic fabric 18 is stitched to cover a blank 19, which is defined by the edges of the panels 20*a* and 20*b* of the fur fabric.

A back panel 21 is shown in FIG. 2 as a single piece, but it may also be made of two sections to provide three-dimensional surfaces to the toy.

The elastic fabric 18 is free of fur and lies flush with the surrounding belly panel 20 areas in its natural state. It may be printed with a message, the name of the toy, or the owner. Therefore, the finished pig toy 10 will be fully enclosed by the fur surfaces and the elastic fabric 18 in the belly. The belly is comprised of an elastic fabric that closes an opening formed by the substantially inelastic plush body shell.

Similarly to other typical plush toys, the head 12 and four legs 14 to 17 have respective cavities filled with cotton batting and the like to give a consistent thickness and softness regardless of their attachment to the center body 11.

Figure 3:
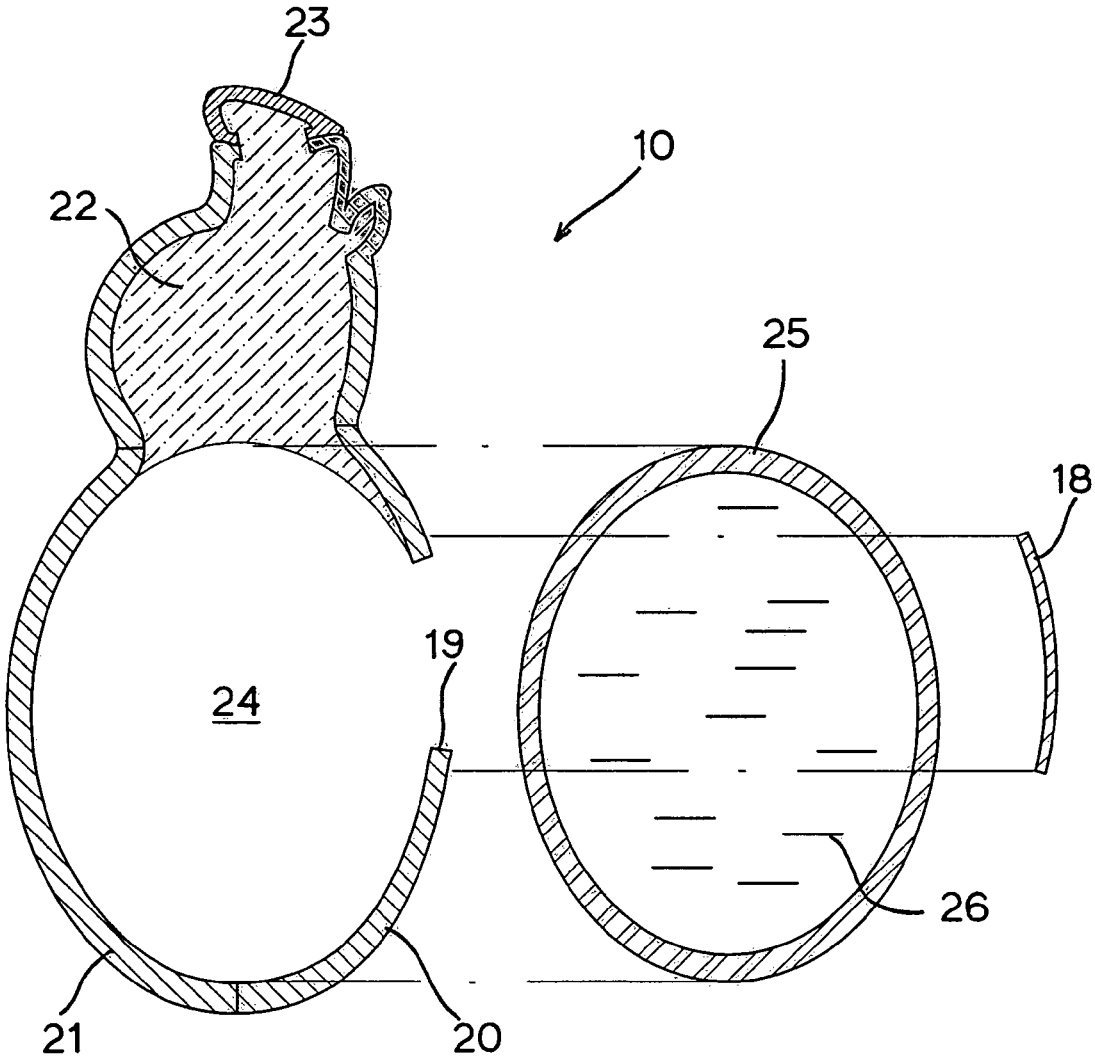
FIG. 3 is a cross sectional view of the squeezable toy of FIG. 1.

FIG. 3 shows the detail of the contents inside of the pig toy 10 with head filler 22. Also shown is a nose 23 comprised of finer fur and attached to the head 12. Inside the center body 11 is a cavity 24 formed by the belly 20 and back 21 panels and end surfaces of the head filler 22 leaving the blank 19 for an access from outside.

A bladder 25 made of elastic material, such as rubber or silicon, is prepared with liquid 26 and filled at least partially to provide an expansive response to squeezes. The bladder 25 is introduced into the cavity 24 through the blank 19 and rests securely therein. The blank 19 is then covered by the elastic fabric 18, which may be stitched to the surrounding belly panel 20 at the blank 19 areas. The bladder 25 is built with enough thickness to withstand the owner's repeated squeezing. An increase in the bladder's elasticity also helps to avoid a pressurized rupture.

Because the bladder 25 is only partially filled, the finished toy 10 makes a distinct sound when jiggled. This particular noise allows potential owners to distinguish the toy from others that may be on the market.

Figure 4:
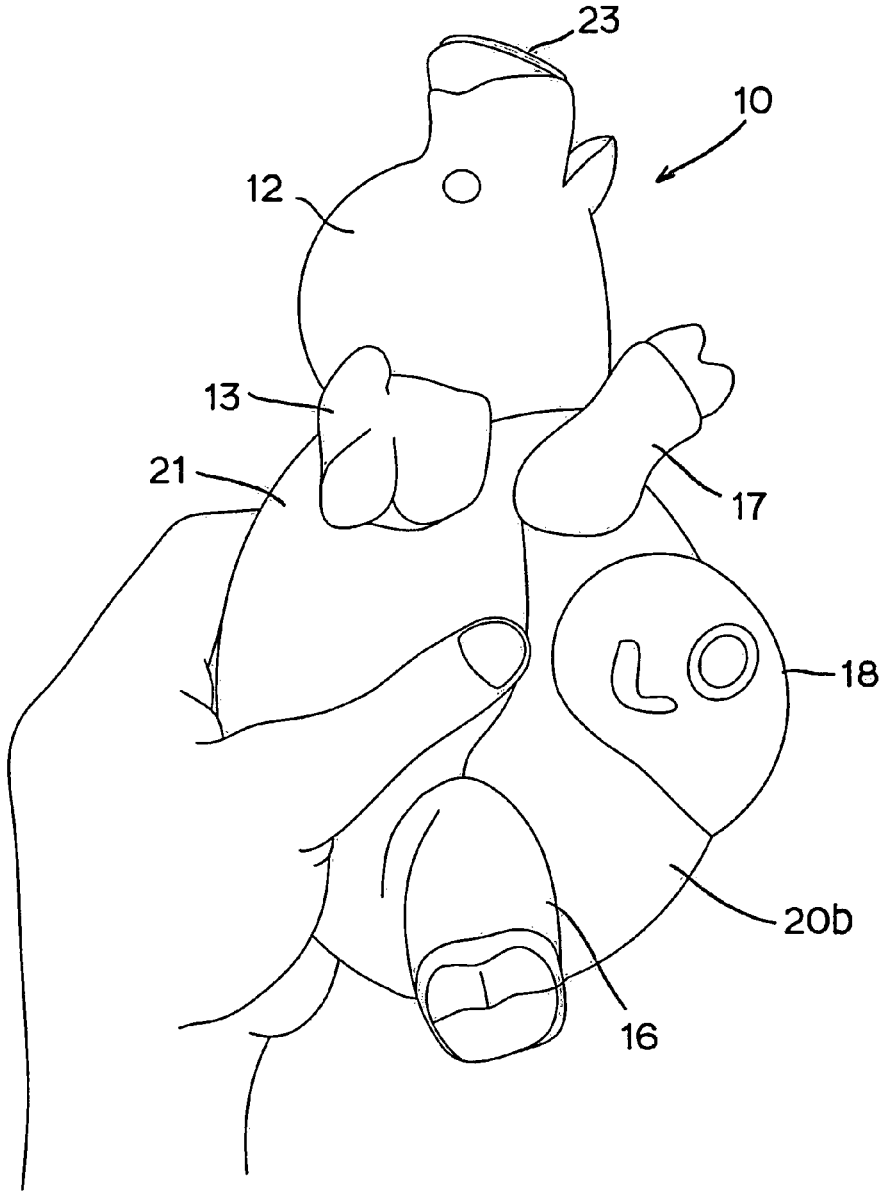
FIG. 4 is a side view of the squeezable toy according to the present invention in operation.

In FIG. 4, the plush pig toy 10 is drawn to demonstrate a situation wherein the toy is squeezed at the center body 11 and the elastic fabric 18 has been bulged out from its natural flat state, as seen in FIG. 1. Thus, one can sense the flesh-like softness of the internal bladder 25 from the outside of the toy while he or she sees it stretched through the elastic fabric interface without breaking into the toy. This increases the cuteness and thermal capacity of the little piggy. The elastic portion can be comprised of microfiber material.

Variations of the disclosed embodiment are easily conceivable. For example, the head 12 may be adapted into the shape of a toy frog wherein an additional bladder is provided and two side elastic fabric members may be attached to preformed blanks. Squeezing such a frog head will bloat the sides, simulating vocal sac movements. The fluid filled bladder can be made of a soft elastic material. The fluid is preferably water, but can also be a gel, a mixture of liquid and air, a liquid saturated foam sponge, or air. A gel can be prepared as an emulsified liquid or solution. In selecting a fluid material, the lifelike approximation to actual weight and density of a live creature is balanced against practical concerns such as total weight and marketable cuteness.

Alternatively, the plush shell can be equipped with a zipper to allow removal of the fluid sack or bladder. There can be multiple bladders, elastic fabric regions and traditionally stuffed regions of varying sizes and shapes to accommodate the species represented.

Therefore, while the presently preferred form of the squeezable toy has been shown and described, and several modifications thereof discussed, persons skilled in this art will readily appreciate that various additional changes and modifications may be made without departing from the spirit of the invention, as defined and differentiated by the following claims.

CALL OUT LIST OF ELEMENTS

10 Toy
11 Center Body
12 Head
13 Ear
14-17 Leg
18 Elastic Fabric
19 Blank
20 Belly Panel
21 Back Panel
22 Head Filler
23 Nose
24 Cavity
25 Bladder

What is claimed is:

1. A plush toy in a three-dimensional shape comprising:

a. a body shell having at least one top shell member of plush fabric material and at least one bottom shell member of plush fabric attached to the top member, the body shell thus defining a cavity in its interior and the bottom shell member having a blank located approximately centrally thereof;

b. an elastic bladder closed with a predetermined amount of liquid deposited therein for filling the cavity of the body shell less the blank; and c. an elastic fabric attached to the bottom shell to cover the blank of the bottom shell in flush with the same, whereby squeezing the elastic bladder through the body shell activates the elastic fabric to expand beyond the surrounding body shell areas in order to reflect the elasticity of the bladder inside, wherein the body shell is a substantially inelastic plush material forming an opening on a belly of the plush toy, wherein the elastic fabric closes the opening on the belly, wherein the elastic bladder does not actuate appendages.

2. The plush toy of claim 1, further comprising a head shell of plush fabric joined end-to-end with the body shell, the head shell having its own elastic bladder closed with a liquid and received therein snuggly.

3. The plush toy of claim 1, further comprising a head shell of plush fabric joined end-to-end with the body shell, the head shell having a cavity filled with a soft padding material.

4. A plush toy of claim 1, further comprising a number of extremities of plush fabric joined end-to-end with the body shell to simulate the equivalent parts of the shape the toy is modeling after, the plush extremities being filled with a soft padding material.

5. The plush toy of claim 1, wherein the elastic fabric has a printable surface with characters or logos.

6. A plush toy animal comprising:

a. a body shell having at least one top shell member of plush fabric material and at least one bottom shell member of plush fabric attached to the top member, the body shell thus defining a cavity in its interior and the bottom shell member having a blank located approximately centrally thereof;

b. a head shell and a number of extremities of plush fabric joined end-to-end with the body shell at its sides, the head shell defining a cavity in its interior and having one or more blanks;

c. at least one elastic bladder closed with a predetermined amount of liquid deposited therein for filling one or both of the cavities of the body and head shells less the blanks; and d. elastic fabric members attached to cover the blanks of the bottom and head shells in flush with the same, whereby squeezing the elastic bladder through the toy at different areas activates an adjacent elastic fabric to expand beyond the surrounding body or head shell areas in order to reflect the elasticity of the bladder inside, wherein the body shell is a substantially inelastic plush material forming an opening on a belly of the plush toy, wherein the elastic fabric closes the opening on the belly, wherein the elastic bladder does not actuate appendages.

7. The plush toy animal of claim 6 wherein the head shell has a cavity filled with a soft padding material.

8. The plush toy animal of claim 6, wherein the plush extremities are filled with a soft padding material.

9. The plush toy of claim 6, wherein the elastic fabric members is microfiber material.

10. A plush toy comprising:

a. a substantially inelastic body shell defining a cavity in its interior, the body shell having an opening;

b. an elastic fluid filled bladder held in the cavity; and c. an elastic fabric attached to the opening, wherein the body shell is a substantially inelastic plush material forming an opening on a belly of the plush toy, wherein the elastic fabric closes the opening on the belly, wherein the elastic bladder does not actuate appendages wherein a head shell of plush fabric joined end-to-end with the body shell, the head shell having a cavity shell with a soft padding material, a plurality of plush extremities being filled with a soft padding material, wherein the elastic fabric has a printable surface with characters or logos, wherein the elastic portion is a microfiber material, wherein the substantially inelastic body shell further comprises at least one top shell member of plush fabric material and at least one bottom shell member of plush fabric attached to the top member, wherein the body shell defines a cavity in its interior.

11. The plush toy of claim 10, wherein the fluid filled bladder is at least partially filled with water.

12. The plush toy of claim 10, wherein the fluid filled bladder is at least partially filled with a gel.

13. The plush toy of claim 10, wherein the fluid filled bladder is at least partially filled with a liquid saturated foam sponge.

14. The plush toy of claim 10, wherein substantially inelastic body shell is equipped with a zipper to allow removal of the fluid sack or bladder fluid filled bladder.

15. The plush toy of claim 10, further comprising plush extremities filled with soft padding material.

* * * * *